US005976754A

United States Patent [19]

Asada et al.

[11] Patent Number: 5,976,754

[45] Date of Patent: Nov. 2, 1999

[54] TONER

[75] Inventors: Hidenori Asada; Masami Tsujihiro; Nobuhiro Hirano; Takuya Kadota; Toshiaki Akiyama; Akemi Uchizono, all of Osaka, Japan

[73] Assignee: Mita Industrial Co., Ltd., Osaka, Japan

[21] Appl. No.: 09/201,811

[22] Filed: Dec. 1, 1998

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS 5,135,833 8/1992 Matsunaga et al. ..... 430/110
5,486,445 1/1996 Van Dusen et al. ..... 430/110
5,843,612 12/1998 Lin et al. ..... 430/110

*Primary Examiner*—Roland Martin
*Attorney, Agent, or Firm*—Smith, Gambrell & Russell, LLP; Beveridge, DeGrandi, Weilacher & Young; Intellectual Property Group

[57] ABSTRACT

Disclosed is a toner comprising a fixing resin, a colorant, a releasant made of a polyolefin having a melting point of not more than 120° C., preferably 60 to 120° C. and a compatibilizing agent for the fixing resin and the releasant, wherein a glass transition temperature Tg of the toner is from 53 to 63° C. and the releasant having a particle diameter of 0.2 to 1.5 $\mu$m is dispersed in the fixing resin. This toner is superior in blocking resistance, filming resistance and the like and is capable of fixing at a low temperature and, therefore, this toner is useful as a toner for image forming apparatus utilizing an electrophotographic process.

4 Claims, No Drawings

TONER

BACKGROUND OF THE INVENTION

The present invention relates to a toner. More particularly, it relates to a toner which is suitably used in image forming apparatuses utilizing an electrophotographic process, such as electrostatic copying machines, laser beam printers and the like.

In these image forming apparatuses, a thermal fixing system, which comprises developing a toner on a photoconductor, transferring the toner to copying paper, and passing the paper through a thermal fixing place to obtain a copied image of fixed toner image, is employed in most cases. Particularly, a thermal rolling system is very often employed under the condition that the surface temperature of the thermal roller is 180 to 200° C., considering heat capacity or heat conductivity of the paper, toner and the like, a setting temperature of which is higher than a softening temperature (120 to 150° C.) of the toner.

With the requirements of high speed and low energy of the electrophotographic process, it has recently been required to develop the toner at a lower temperature, e.g. the surface temperature of a thermal roller of not more than 170° C.

Therefore, there has been made a trial of reducing the molecular weight of a binding resin to lower a softening temperature or reducing a glass transition temperature (Tg) to improve the fixing properties of the toner at a low temperature range. However, since the viscosity is also lowered by reducing the molecular weight of the fixing resin, when toner image is melt-fixed between thermal rollers, a part of the toner is transferred to the rollers, and transferred components cause scumming to the copied image, that is, so-called offset occurs. Furthermore, the toner before image formation is aggregated under a high temperature environment, that is, so-called blocking occurs.

For the purpose of inhibiting hot offset and blocking, there has been suggested a toner prepared by blending releasants such as lower molecular weight polypropylene (e.g. polyethylene, polypropylene, etc.) and natural wax. However, since the fixing resin has small affinity to the releasant, a poorly dispersed wax is released from the toner particles. The wax components thereby cause scumming and melt-adhering to a photoconductor drum, that is so-called filming, a dash mark and the like occur. For preventing toner-blocking, a fixing resin having a comparatively higher glass transition temperature, has been considered but such a method can not be employed because the fixing ability is inhibited.

SUMMARY OF THE INVENTION

It is a main object of the present invention to provide a toner which is superior in blocking resistance and filming resistance and is capable of fixing at a low temperature.

The present inventors have studied intensively in order to accomplish the above object. As a result, they have found that a toner, which is superior in blocking resistance and filming resistance and is capable of fixing at a low temperature, can be obtained by constructing a toner comprising a fixing resin, a colorant, a releasant made of a polyolefin having a melting point of not more than 120° C. and a compatibilizing agent for the fixing resin and the releasant, wherein a glass transition temperature Tg of the toner is 53 to 63° C. and the releasant having a particle diameter of 0.2 to 1.5 μm is dispersed in the fixing resin. Thus, the present invention has been completed.

That is, the present invention relates to a toner comprising a fixing resin, a colorant, a releasant made of a polyolefin having a melting point of no more than 120° C., and a compatibilizing agent for the fixing resin and the releasant, wherein a glass transition temperature Tg of the toner is 53 to 63° C. and the releasant having a particle diameter of 0.2 to 1.5 μm is dispersed in the fixing resin.

DETAILS OF THE INVENTION

The present invention will be described in detail hereinafter.

The toner of the present invention contains a fixing resin, a colorant, a releasant and a compatibilizing agent, as described above, and when the glass transition temperature Tg of the whole toner is 53 to 63° C., it exhibits a good quality. When Tg of the toner is lower than 53° C., toner-blocking or aggregation on a photoconductor of the toner occurs, thereby causing the problem that a dash mark is formed on the formed image. On the other hand, when Tg of the toner exceeds 63° C., it becomes difficult to fix at a low temperature range, e.g. not more than 160° C. The Tg of the toner is adjusted according to Tg of the fixing resin and components in the resin, as described hereinafter.

Examples of the fixing resin include styrenic resin (homopolymer or copolymer containing styrene or a styrene substitute) such as polystyrene, chloropolystyreane, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid copolymer (e.g. styrene-acrylic acid copolymer, styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylic acid copolymer (e.g. styrene-methacrylic acid copolymer, styrene-methyl methacrylate copolymer, styrene-ethyl methacrylate copolymer, styrene-butyl methacrylate copolymer, styrene-phenyl methacrylate copolymer, etc.), styrene-α-chloromethyl acrylate copolymer, styrene-acrylonitrile-acrylate copolymer, etc.; and polyvinyl chloride, low molecular weight polyethylene, low molecular weight polypropylene, ethylene-ethyl acrylate copolymer, polyvinyl butyral, ethylene-vinyl acetate copolymer, rosin-modified maleic resin, phenol resin, epoxy resin, polyester resin, ionomer resin, polyurethane resin, silicone resin, ketone resin, xylene resin, polyamide resin, etc. These resins may be used alone or in combination thereof.

Since the glass transition temperature Tg of the fixing resin exerts a large influence on the glass transition temperature Tg of the whole toner, it is necessary to use a fixing resin having a proper Tg so that Tg of the whole toner is within the above range. Accordingly, Tg of the fixing resin itself is not specifically limited, but is preferably within a range from about 50 to 65° C. Tg of the whole toner becomes lower at a few degrees than that of the fixing resin according to the other components such as releasant and the like and, therefore, Tg of the fixing resin is preferably set to be higher at a few degrees than Tg of targetted toner.

Regarding the molecular weight of the fixing resin, a weight-average molecular weight Mw is within a range from 10,000 to 3,000,000, preferably from 50,000 to 1,000,000, and a number-average molecular weight Mn is within a range from 2,000 to 20,000, preferably from 3,000 to 10,000, considering that Tg of the glass transition temperature Tg of the resin is set within the above range. A ratio Mw/Mn, which indicates a molecular weight distribution, is within a range from 10 to 50, and preferably from 20 to 40.

In the present invention, polyolefin is used as the releasant. The polyolefin includes, for example, polyethylene, polyisobutyrene, polybutene, polypentene, polyhexene or the like. Among them, a releasant made of polyethylene is preferably used because it is superior in offset resistance to a releasant made of the other polyolefin such as polypropylene.

The melting point of the above releasant is no more than 120° C., and preferably is set within a range from 60 to 120° C. When the melting point of the above releasant exceeds the above range, it becomes difficult to fix at a low temperature. To the contrary, when the melting point is lower than 60° C., since a toner melt-adhering on a photoconductor can not be cleaned, there is a fear that a dash mark or filming is liable to occur and blocking is liable to occur during the storage of the toner.

Although the molecular weight of the releasant is not specifically limited, the weight-average molecular weight Mw is within a range from 1,000 to 100,000, preferably from 6,000 to 40,000, and the number-average molecular weight is within a range from 1,000 to 300,000, preferably from 3,000 to 12,000, taking the melting point of the releasant, effect of enhancing the offset resistance, viscosity of the releasant itself or the like into consideration. The ratio Mw/Mn, which indicates a molecular weight distribution, is within a range from 1 to 5, and preferably from 1.05 to 3.

The amount of the releasant is set within a range from 1 to 10 parts by weight, and preferably from 2 to 6 parts by weight. In view of an improvement in offset resistance, the larger the amount of the releasant, the better. When the amount exceeds the above range, it becomes impossible to uniformly disperse in the fixing resin and a harmful influence is exerted on the charging properties of the toner, unfavorably. To the contrary, when the amount is lower than the above range, the effect of improving the offset resistance becomes insufficient.

A dispersion particle diameter (particle diameter in the state of being dispersed in the toner) of the releasant in the toner of the present invention is set within a range from 0.2 to 1.5 $\mu$m, preferably from 0.3 to 1.2 $\mu$m, and more preferably from 0.4 to 1.0 $\mu$m, by blending a compatibilizing agent described hereinafter. When the dispersion particle diameter exceeds the above range, the releasant is liable to be eliminated from the toner and it becomes impossible to obtain the effect of inhibiting filming onto a photoconductor drum, unfavorably. To the contrary, when the dispersion particle diameter is lower than the above range, it becomes impossible to obtain the effect due to blending of the releasant and the offset resistance is lowered, for example, hot offset arises unfavorably.

The compatibilizing agent exerts an operation of forming a thin layer at the interface between the fixing resin and releasant, thereby to enhance the affinity between them. As a result, dispersion properties of the dispersant in the fixing resin are enhanced and the releasant having a small particle diameter is uniformly dispersed in the fixing resin.

Since the above compatibilizing agent is required to have good compatibility to both the fixing resin and releasant, a copolymer (preferably graft polymer or block polymer) of a monomer constituting the fixing resin and a monomer constituting the releasant is preferably used.

In the present invention, when polyethylene is used as the releasant and a styrenic resin is used as the fixing resin, the compatibilizing agent is preferably a styrene-ethylene graft copolymer or a stylene-ethylene block copolymer. The amount of the compatibilizing is determined according to kinds or properties thereof, but is generally set within a range from 0.1 to 10 parts by weight, and preferably 1 to 6 parts by weight, based on 100 parts by weight of the fixing resin.

As the colorant used in the toner of the present invention, there can be used various dyes, pigments, etc., which have hitherto been known. In case of black toner, a carbon black is mainly used. Carbon black includes, for example, various carbon blacks which have hitherto been known, such as channel black, roller black, disc black, gas furnace black, oil furnace black, thermal black, acetylene black and the like.

The amount of the colorant is not specifically limited, but is preferably set within a range from 3 to 15 parts by weight based on 100 parts by weight of the fixing resin. In case that the colorant is carbon black, since the carbon black itself has a conductivity, the amount of the colorant is preferably set considering electric characteristics of the toner into consideration.

Other components to be blended in the fixing resin include, for example, electric charge controlling material (or electric charge controlling resin), various stabilizers and the like.

Among them, as the electric charge controlling (or electric charge controlling resin), any one of electric charge controlling materials for controlling positive electric charge and negative electric charge according to charging polarity of the toner can be used.

The electric charge controlling material for controlling positive electric charge includes, for example, organic compounds containing a basic nitrogen atom, such as basic dye, aminopyridine, pyrimidine compound, polynuclear polyamino compound, aminosilanes and the like; and fillers surface-treated with the above compounds. The electric charge controlling resin for controlling positive electric charge includes, for example, styrenic resins containing a basic nitrogen atom.

The electric charge controlling material for controlling negative electric charge includes, for example, compounds containing a carboxyl group, such as metal chelete alkyl salicylate and the like; metal complex dye, fatty metal soaps, fatty acid soap, metal naphthenate; and oil-soluble dyes such as nigrosine base (C.I. 5045), oil black (C.I. 26150), bonthrone S, spiron black and the like. The electric charge controlling resin for controlling negative electric charge includes, for example, styrene-styrenesulfonic acid copolymer or the like.

The amount of the electric charge controlling material (or electric charge controlling resin) is set within a range from 0.1 to 10 parts by weight, and preferably from 0.5 to 5 parts by weight, based on 100 parts by weight of the fixing resin.

When the toner of the present invention is used as a magnetic toner used in an image forming apparatus of a magnetic one-component developing system, various known magnetic powders, for example, metals such as cobalt, iron, nickel, aluminum, copper, magnesium, tin, zinc, antimony, beryllium, bismuth, calcium, selenium, titanium, tungsten, vanadium or the like, or compounds (oxides), alloys or mixtures thereof. The amount of the magnetic powder is set within a range from 20 to 300 parts by weight, and preferably from 50 to 150 parts by weight, based on 100 parts by weight of the fixing resin.

The above magnetic powder may be blended in the toner used in an image forming apparatus of a two-component developing system for the purpose of preventing scattering of the toner. In this case, the magnetic powder is blended in the proportion of about 0.1 to 10 parts by weight based on 100 parts by weight of the fixing resin.

The toner of the present invention is produced by a method (so-called grinding method) of mixing the above fixing resin with a releasant, a colorant and, if necessary, other components; homogeneously premixing them using a dry blender, Henshel mixer, ball mill or the like; melting and kneading the resulting mixture using a kneading device such as single or twin screw kneading extruder; grinding the resulting kneaded product; and optionally classifying the ground particles. The toner can also be produced, for example, by a spray drying method, a suspension polymerization method, a dispersion polymerization method or the like.

The particle diameter of the toner of the present invention is not specifically limited, but may be within a range to be normally used. When using as a toner having a small particle diameter, the particle diameter is adjusted so that a volume basis average particle diameter (median diameter due to a callter counter) is from 5 to 11 μm, and preferably from 7 to 10 μm.

To the toner produced from the above respective components, various additives may be added to improve the fluidity and charging characteristics. As the additive, for example, there can be used those, which have hitherto been known, such as fine powders of metal oxides such as aluminum oxide, silicon oxide, titanium oxide, zinc oxide and the like and fine particle of fluororesin. Particularly, a silica surface treating agent containing hydrophobic or hydrophilic silica fine particles, specifically anhydrous silica in the form of ultrafine particles, colloidal silica or the like, is preferably used. The amount of the additive is not specifically limited, but is preferably about 0.1 to 3.0 parts by weight based on 100 parts by weight of the toner.

The toner of the present invention is superior in blocking resistance and filming resistance and is capable of fixing at low temperature and, therefore, the toner can be preferably used in image forming apparatuses utilizing an electrophotographic process, such as electrostatic copying machine, laser beam printer and the like.

The following Examples and Comparative Examples further illustrate the present invention in detail.

EXAMPLES 1–8 AND REFERENCE EXAMPLES 1–7

As a fixing resin, a styrene-butyl acrylate copolymer (weight-average molecular weight Mw: 202,000, number-average molecular weight Mn: 6,000, Mw/Mn: 33.7) was used. It is possible to control the Tg of the resin according to usage ratio of a styrene monomer and a butyl acrylate monomer. In the case of the present resin, Tg of the resin can be controlled from 68 to 55° C. by controlling a usage ratio of a styrene monomer and a butyl acrylate monomer from 89/11 to 85/15% by weight.

Matrix particles of a toner were made by mixing 100 parts by weight of the above fixing resin with 7 parts by weight of carbon black (colorant), 5 part by weight of polyethylene (releasant), 0.05 to 12 parts by weight of a styrene-ethylene graft copolymer (compatibilizing agent) and 5 parts by weight of a styrene-dimethylaminoethyl methacrylate copolymer (electric charge controlling resin) using a Henschel mixer, melting and kneading the mixture using a twin screw extruder, grinding the extruded product using a jet mill, and classifying the ground particles using an air classification device.

Then, 100 parts by weight of the above matrix particles and 1 part by weight of a hydrophobic silica were mixed by using a Henschel mixer to obtain a toner. The resulting toner was mixed with a ferrite carrier so that the toner concentration became 4% by weight to prepare a developer.

A melting point (° C.) and a glass transition temperature T (° C.) of each polyethylene used in the Examples and Comparative Examples are shown in Table 1 below. Using the resulting toner, a practical machine test was performed by a method described below and each quality was evaluated.

(Dispersion particle diameter of polyethylene)

The dispersion particle diameter (μm) of polyethylene was determined as an area mean diameter (mediam diameter) by cutting toners obtained in the Examples and Comparative Examples using a microtome and then analyzing an image obtained by taking a photograph using a transparent electron microscope (TEM).

Practical Machine Test

An electrostatic copying machine (trade name: "Anesis 6040", manufactured by Mita Industrial Co., Ltd.) (analogue system) was modified to a digital system. Using this electrostatic copying machine, a practical machine test of the above developer was performed and the following evaluations were performed.

Dash Mark

Copies of an original were taken by using the above copying machine and formed images after taking 200,000 copies were visually observed. When dash mark occurred, it means that printing defect occurred.

Fixing Rate

An image was formed by setting the temperature of a fixing roller to 160° C. or 190° C., and an image density ($ID_1$) of a solid image and an image density ($ID_2$) after forcibly rubbing the surface of a paper, on which a solid image was formed by using a weight (40 g/cm$^2$) obtained by coating a cylinder made of a mild steel having a height of 26 mm and a diameter of 50 mm with a cotton cloth, five times were measured. Then, a fixing rate F (%) of the toner was determined by the following equation.

$$F(\%)=(ID_2-ID_1)\times 100$$

An image density was measured by using a reflection densitometer (white light photometer "TC-6D", manufactured by Tokyo Denshoku Co/. Ltd.).

It is required that the fixing rate is not less than 90%.

Hot Offset

The surface temperature of a fixing roller was adjusted to from 180° C. (low temperature) to 240° C. (high temperature) at 5° C. intervals. Whether or not hot offset occurred at 190° C. (standard temperature) was examined, and a temperature of the fixing roller to occur hot offset was examined.

Filming

After taking 10,000 copies, blur in solid images was visually observed. Then, evaluation of filming was performed by the following criteria.

Blocking

Toner was charged with a toner cartridge and allowed to stand at 50° C. for 8 hours. After the cartridge was set in a copy machine, it was examined whether or not the charged toner can be discharged from the cartridge without occurring of blocking.

TABLE 1

| | Examples | | |
|---|---|---|---|
| | 1 | 2 | 3 |
| Object | Upper limit of Toner Tg | Lower limit of Toner Tg | Upper limit of releasant's dispersion particle diameter Lower limit of compatibilizing agent's number |
| Toner Tg (° C.) | 63 | 53 | 58 |
| Dispersion particle diameter of releasant (μm) | 0.6 | 0.6 | 1.5 |
| Polyethylene (5 parts by weight) Melting point (° C.) | 100 | 100 | 100 |
| Number of compatibilizing agent | 3 | 3 | 0.1 |
| Tg of the resin | 66 | 58 | 62 |
| Fixing rate (%) 190° C. (Standard) | 96 | 99 | 97 |
| 160° C. (Low) | 92 | 94 | 93 |
| Hot offset (190° C. at the setting) | none | none | none |
| Hot offset occurred temperature (° C.) | 235 | 215 | 235 |
| Dash mark | none | none | none |
| Filming | none | none | none |
| Blocking (50° C., 8 hrs.) | none | none | none |
| Total Judgment | Good | Good | Good |

| | Examples | |
|---|---|---|
| | 4 | 5 |
| Object | Lower limit of releasant's dispersion particles diameter Upper limit of compatibilizing agent's number | Releasant's dispersion particle diameter |
| Toner Tg (° C.) | 58 | 58 |
| Dispersion particle diameter of releasant (μm) | 0.2 | 1.0 |
| Polyethylene (5 parts by weight) Melting point (° C.) | 100 | 100 |
| Number of compatibilizing agent | 9 | 2 |
| Tg of the resin | 62 | 62 |
| Fixing rate (%) 190° C. (Standard) | 96 | 97 |
| 160° C. (Low) | 92 | 93 |
| Hot offset (190° C. at the setting) | none | none |
| Hot offset occurred temperature (° C.) | 215 | 230 |
| Dash mark | none | none |
| Filming | none | none |
| Blocking (50° C., 8 hrs.) | none | none |
| Total Judgment | Good | Good |

| | Examples | | |
|---|---|---|---|
| | 6 | 7 | 8 |
| Object | Releasant's dispersion particle diameter | Releasant's upper limit of melting point | Releasant's lower limit of melting point |
| Toner Tg (° C.) | 58 | 58 | 58 |
| Dispersion particle diameter of releasant (μm) | 0.4 | 0.7 | 0.6 |
| Polyethylene (5 parts by weight) Melting point (° C.) | 100 | 120 | 60 |
| Number of compatibilizing agent | 6 | 3 | 3 |
| Tg of the resin | 62 | 62 | 62 |
| Fixing rate (%) 190° C. (Standard) | 96 | 96 | 99 |
| 160° C. (Low) | 92 | 91 | 95 |
| Hot offset (190° C. at the setting) | none | none | none |
| Hot offset occurred temperature (° C.) | 230 | 235 | 215 |
| Dash mark | none | none | none |
| Filming | none | none | none |
| Blocking (50° C., 8 hrs.) | none | none | none |
| Total Judgment | Good | Good | Good |

TABLE 1-continued

| | Comparative Examples | | |
|---|---|---|---|
| | 1 | 2 | 3 |
| Object | Tg over | Tg under | Releasant's dispersion particle diameter over Compatibilizing agent's number under |
| Toner Tg (° C.) | 65 | 52 | 58 |
| Dispersion particle diameter of releasant (μm) | 0.6 | 0.6 | 1.65 |
| Polyethylene (5 parts by weight) Melting point (° C.) | 100 | 100 | 100 |
| Number of compatibilizing agent | 3 | 3 | 0.05 |
| Tg of the resin | 68 | 56 | 62 |
| Fixing rate (%) 190° C. (Standard) | 89 | 99 | 97 |
| 160° C. (Low) | 80 | 94 | 93 |
| Hot offset (190° C. at the setting) | none | occurred | none |
| Hot offset occurred temperature (° C.) | 240 | 190 | 235 |
| Dash mark | none | occurred | occurred |
| Filming | none | none | occurred |
| Blocking (50° C., 8 hrs.) | none | occurred | none |
| Total Judgment | Poor | Poor | Poor |

| | Comparative Examples | |
|---|---|---|
| | 4 | 5 |
| Object | Releasant's dispersion particles diameter under Compatibilizing agent's number over | Releasant's melting point over |
| Toner Tg (° C.) | 58 | 58 |
| Dispersion particle diameter of releasant (μm) | 0.1 | 0.7 |
| Polyethylene (5 parts by weight) Melting point (° C.) | 100 | 130 |
| Number of compatibilizing agent | 12 | 3 |
| Tg of the resin | 62 | 62 |
| Fixing rate (%) 190° C. (Standard) | 96 | 90 |
| 160° C. (Low) | 92 | 84 |
| Hot offset (190° C. at the setting) | occurred | none |
| Hot offset occurred temperature (° C.) | 180 | 240 |
| Dash mark | none | none |
| Filming | none | none |
| Blocking (50° C., 8 hrs.) | none | none |
| Total Judgment | Poor | Poor |

| | Comparative Examples | |
|---|---|---|
| | 6 | 7 |
| Object | Releasant's melting point under | Compatibilizing agent, not use |
| Toner Tg (° C.) | 58 | 58 |
| Dispersion particle diameter of releasant (μm) | 0.6 | 3.0 |
| Polyethylene (5 parts by weight) Melting point (° C.) | 50 | 100 |
| Number of compatibilizing agent | 3 | 0 |
| Tg of the resin | 62 | 62 |
| Fixing rate (%) 190° C. (Standard) | 99 | 98 |
| 160° C. (Low) | 93 | 94 |
| Hot offset (190° C. at the setting) | none | none |
| Hot offset occurred temperature (° C.) | 210 | 240 |
| Dash mark | occurred | occurred |
| Filming | occurred | occurred |
| Blocking (50° C., 8 hrs.) | occurred | none |
| Total Judgment | Poor | Poor |

As is apparent from Table 1, according the to toners of Examples 1 to 8 wherein the glass transition temperature Tg of the toner is 53 to 63° C. and the melting point of polyethylene as the releasant is 60 to 120° C. and, furthermore, the dispersion particle diameter of said polyethylene is set within a range from 0.2 to 1.5 μm, defects such as dash mark, hot offset, filming and toner blocking did not occur and the fixing rate of the toner at 160° C. was also good.

To the contrary, toners of Comparative Examples 1 to 7 were inferior in any one of fusing resistance, filming resistance and fixing rate at a low temperature This application claims priority benefits under 35 USC 119 on the basis of Japanese Patent Application No. 9-341671 filed to the Japanese Patent Office on Dec. 11, 1997 and Japanese Patent Application No. 10-311826 filed to the Japanese Patent Office on Nov. 2, 1998, the disclosure thereof being incorporated herein by reference.

What is claimed is:

1. A toner comprising:

a fixing resin, a colorant, a releasant, made of a polyolefin having a melting point of not more than 120° C., dispersed in the fixing resin, and a compatibilizing agent, for compatibilizing the fixing resin and the releasant, wherein a glass transition temperature Tg of said toner is from 53 to 63° C., and said releasant has a particle diameter of 0.2 to 1.5 μm when dispersed in the fixing resin.

2. The toner according to claim 1, wherein the melting point of the releasant is from 60 to 120° C.

3. The toner according to claim 1, wherein the compatibilizing agent is a copolymer of a monomer constituting the fixing resin and a monomer constituting the releasant.

4. The toner according to claim 1, wherein said releasant, colorant and compatibilizing agent are contained in a proportion of 1 to 10 parts by weight, 3 to 15 parts by weight and 0.1 to 10 parts by weight, respectively, based on 100 parts by weight of the fixing resin.

* * * * *

UNITED STATES PATENT AND TRADEMARK OFFICE

CERTIFICATE OF CORRECTION

PATENT NO. : 5,976,754
DATED : November 2, 1999
INVENTOR(S) : Hidenori ASADA et al.

It is certified that error appears in the above-indentified patent and that said Letters Patent is hereby corrected as shown below:

IN THE TITLE PAGE:

In Section [30], the Foreign Application Priority Data, please insert the information as follows:

[30] Foreign Application Priority Data
December 11, 1997 [JP] Japan.....9-341671
November 2, 1998 [JP] Japan.....10-311826

Signed and Sealed this

Third Day of April, 2001

*Attest:*

Nicholas P. Godici

NICHOLAS P. GODICI

*Attesting Officer*

*Acting Director of the United States Patent and Trademark Office*